US005738243A

United States Patent [19]

Broadstreet

[11] Patent Number: 5,738,243

[45] Date of Patent: Apr. 14, 1998

[54] SMALL PARTS VENDING MACHINE FOR AIRPLANES

[76] Inventor: Glenn G. Broadstreet, 163 Pleasant Ave. #3, Auburn, Calif. 95603

[21] Appl. No.: 742,215

[22] Filed: Oct. 31, 1996

[51] Int. Cl.[6] ..... G07F 11/00

[52] U.S. Cl. ..... 221/2; 221/7; 221/75; 221/131; 221/195

[58] Field of Search ..... 221/75, 2, 7, 8, 221/130, 131, 195

[56] References Cited

U.S. PATENT DOCUMENTS

| | | | |
|---|---|---|---|
| 4,757,915 | 7/1988 | Albright et al. | 221/75 |
| 4,961,507 | 10/1990 | Higgins | 221/129 |
| 5,205,436 | 4/1993 | Savage | 221/75 |
| 5,303,844 | 4/1994 | Muehlberger | 221/75 |

FOREIGN PATENT DOCUMENTS

| | | | |
|---|---|---|---|
| WO 94/02915 | 2/1994 | WIPO | 221/8 |

*Primary Examiner*—H. Grant Skaggs

[57] ABSTRACT

A small parts vending machine for airplanes including a housing having an opening therethrough in a lower portion thereof. The housing includes a dispensing ramp secured therein the hollow interior. A powering and programming computer is secured within the housing to a rear wall thereof. An input portion is secured to a front wall of the housing. The input portion is electrically coupled with the powering and programming computer. A credit card input portion is secured to the front wall of the housing. The credit card input portion is electrically coupled with the powering and programming computer. A plurality of dispensing coils each are secured within the housing to the rear wall thereof. The dispensing coils are operably coupled with the powering and programming computer for the dispensing of small airplane parts at times when parts are otherwise unavailable.

1 Claim, 3 Drawing Sheets

Fig. 3
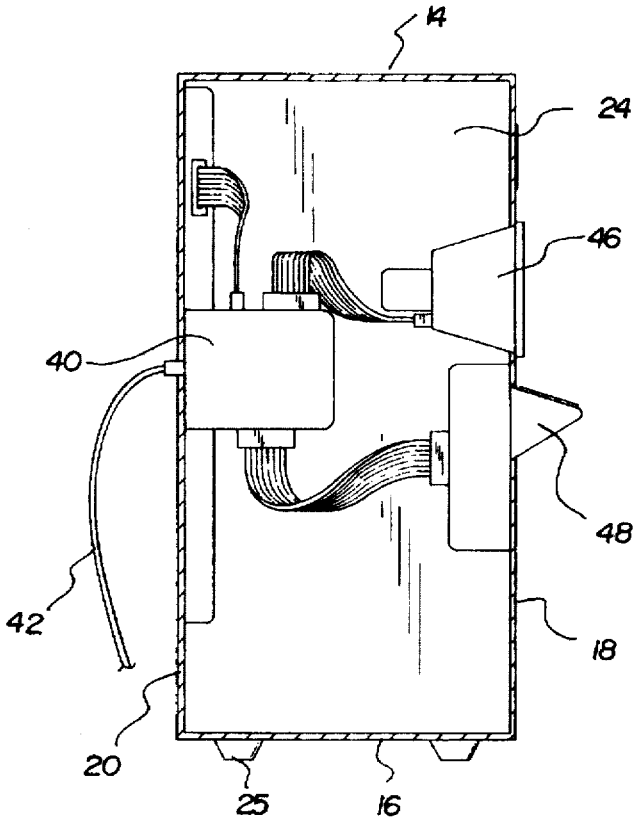
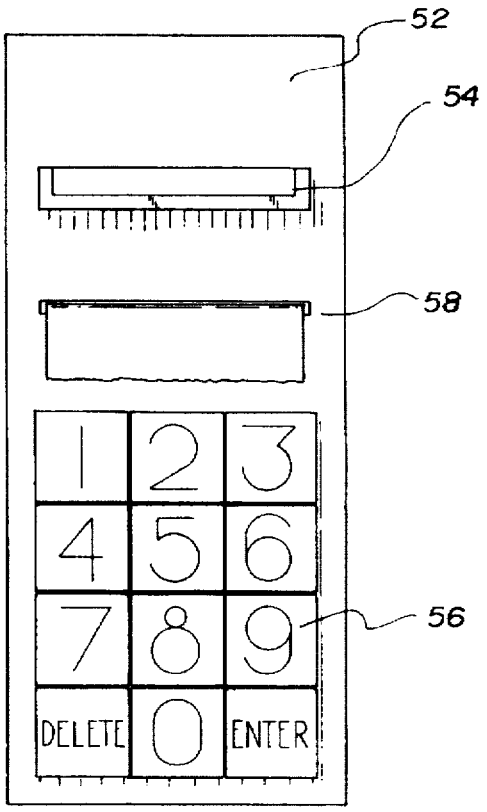
Fig. 4

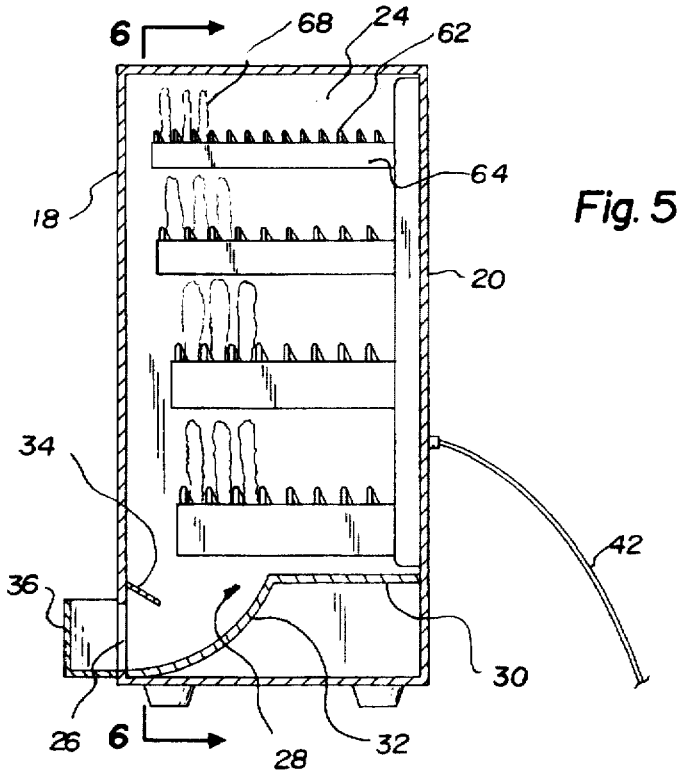
Fig. 5
Fig. 6
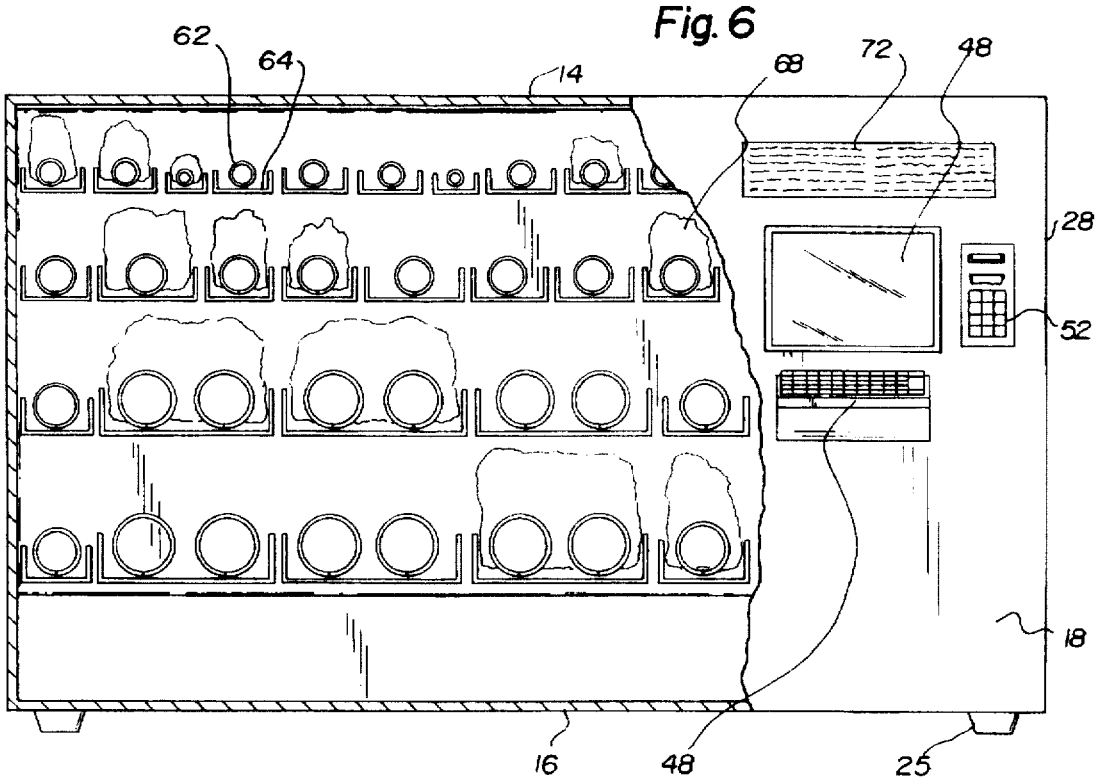

SMALL PARTS VENDING MACHINE FOR AIRPLANES

BACKGROUND OF THE INVENTION

1. Field of the Invention

The present invention relates to a small parts vending machine for airplanes and more particularly pertains to dispensing small airplane parts at times when parts are otherwise unavailable with a small parts vending machine for airplanes.

2. Description of the Prior Art

The use of credit card activated vending machines is known in the prior art. More specifically, credit card activated vending machines heretofore devised and utilized for the purpose of accepting credit cards for items in a vending machine are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,995,255 to Cuttill discloses automatic vending equipment and credit purchase systems.

U.S. Pat. No. 3,872,438 to Cuttill et al. discloses a credit card and credit card identification system for automatic vending equipment.

U.S. Pat. No. 5,055,657 to Miller et al. discloses a vending type machine dispensing a redeemable credit voucher upon payment interrupt.

U.S. Pat. No. 3,691,527 to Yamamoto discloses a credit card actuated vending system.

U.S. Pat. No. 3,457,391 to Yamamoto discloses a vending apparatus for use with credit.

U.S. Pat. No. 3,463,308 to Deneke discloses a vending device for pins, needles, hardware or the like.

While these devices fulfill their respective, particular objective and requirements, the aforementioned patents do not describe a small parts vending machine for airplanes for dispensing small airplane parts at times when parts are otherwise unavailable.

In this respect, the small parts vending machine for airplanes according to the present invention substantially departs from the conventional concepts and designs of the prior art, and in doing so provides an apparatus primarily developed for the purpose of dispensing small airplane parts at times when parts are otherwise unavailable.

Therefore, it can be appreciated that there exists a continuing need for new and improved small parts vending machine for airplanes which can be used for dispensing small airplane parts at times when parts are otherwise unavailable. In this regard, the present invention substantially fulfills this need.

SUMMARY OF THE INVENTION

In the view of the foregoing disadvantages inherent in the known types of credit card activated vending machines now present in the prior art, the present invention provides an improved small parts vending machine for airplanes. As such, the general purpose of the present invention, which will be described subsequently in greater detail, is to provide a new and improved small parts vending machine for airplanes and method which has all the advantages of the prior art and none of the disadvantages.

To attain this, the present invention essentially comprises a housing having a generally rectangular configuration. The housing having a top wall, a bottom wall, a front wall, a rear wall, two side walls, and a hollow interior. The front wall has an opening therethrough in a lower portion thereof. The housing includes a dispensing ramp secured within the hollow interior. The dispensing ramp comprises a planar portion having a first end secured to the rear wall. The dispensing ramp includes an arcuate portion having an upper end secured to a second end of the planar portion. A lower end of the arcuate portion terminates at the opening in the front wall. An anti-theft bar comprised of a planar member is secured to an inner surface of the front wall disposed above the opening therethrough in an angular orientation. A dispensing bin is secured to the front wall disposed under the opening therethrough. A powering and programming means is secured within the hollow interior of the housing to the rear wall thereof. An input means comprised of a computer screen and key board is secured to the front wall of the housing. The computer screen and key board are electrically coupled with the powering and programming means. A credit card input portion is secured to the front wall of the housing. The credit card input portion is comprised of an input slot, a keyboard, and a receipt dispenser. The credit card input portion is electrically coupled with the powering and programming means. The device includes a plurality of dispensing coils each having a generally U-shaped housing. Each of the coils is secured within the hollow interior of the housing to the rear wall thereof. The dispensing coils are operably coupled with the powering and programming means. A plurality of airplane parts are removably disposed within the plurality of dispensing coils.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved small parts vending machine for airplanes which has all the advantages of the prior art credit card activated vending machines and none of the disadvantages.

It is another object of the present invention to provide a new and improved small parts vending machine for airplanes which may be easily and efficiently manufactured and marketed.

It is a further object of the present invention to provide a new and improved small parts vending machine for airplanes which is of durable and reliable construction.

An even further object of the present invention is to provide a new and improved small parts vending machine for airplanes which is susceptible of a low cost of manufacture with regard to both materials and labor, and which accordingly is then susceptible of low prices of sale to the consuming public, thereby making such a small parts vending machine for airplanes economically available to the buying public.

Still yet another object of the present invention is to provide a new and improved small parts vending machine for airplanes which provides in the apparatuses and methods of the prior art some of the advantages thereof, while simultaneously overcoming some of the disadvantages normally associated therewith.

Even still another object of the present invention is to provide a new and improved small parts vending machine for airplanes for dispensing small airplane parts at times when parts are otherwise unavailable.

Lastly, it is an object of the present invention to provide a new and improved small parts vending machine for airplanes including a housing having an opening therethrough in a lower portion thereof. The housing includes a dispensing ramp secured therein the hollow interior. A powering and programing means is secured within the housing to a rear wall thereof. An input means is secured to a front wall of the housing. The input means is electrically coupled with the powering and programming means. A credit card input portion is secured to the front wall of the housing. The credit card input portion is electrically coupled with the powering and programming means. A plurality of dispensing coils each are secured within the housing to the rear wall thereof. The dispensing coils are operably coupled with the powering and programming means for the dispensing of small airplane parts at times when parts are otherwise unavailable.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view taken in cross-section along line 3—3 of FIG. 1.

FIG. 4 is a front view of the credit card portion of the present invention.

FIG. 5 is a side elevation view of the present invention taken in cross-section along line 5—5 of FIG. 1.

FIG. 6 is a front elevation view of the present invention taken in cross-section along line 6—6 of FIG. 5.

The same reference numerals refer to the same parts through the various Figures.

DESCRIPTION OF THE PREFERRED EMBODIMENT

Figure 1:
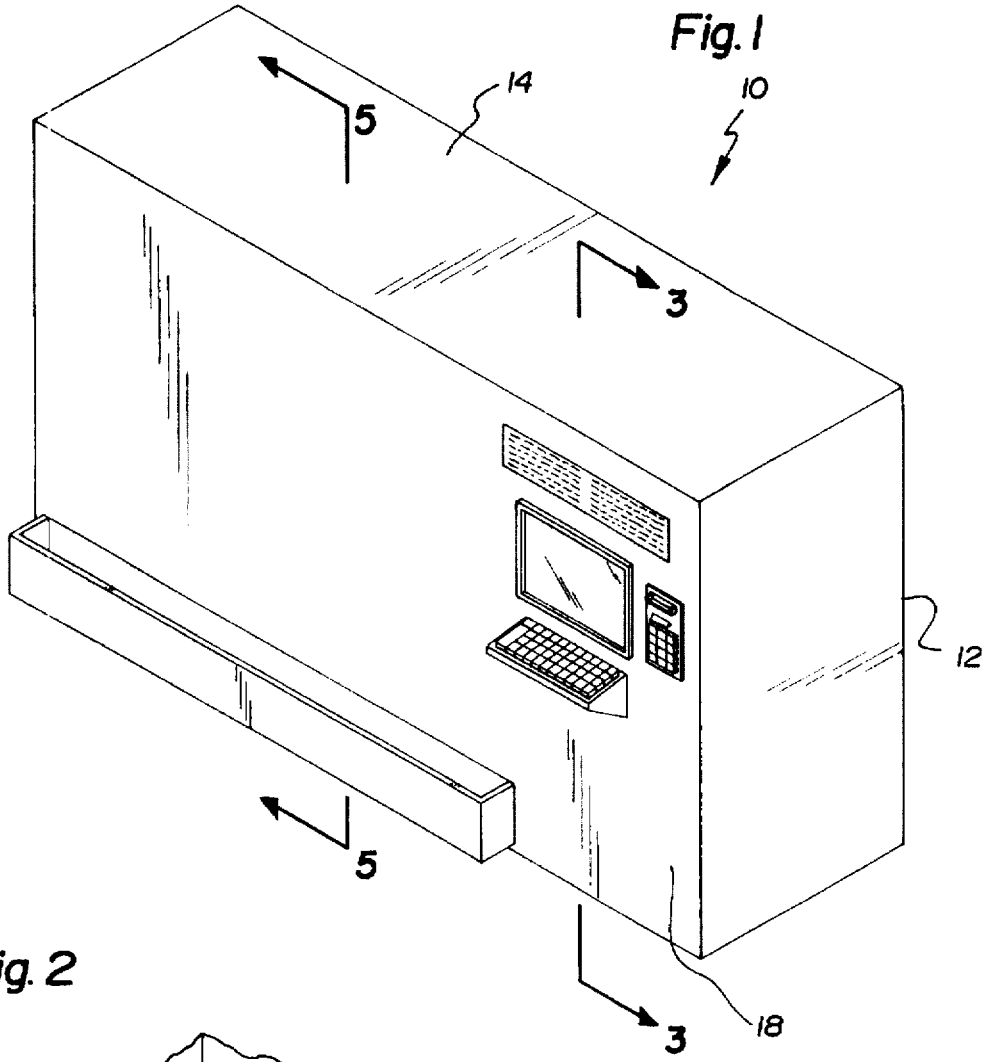
FIG. 1 is a perspective view of the preferred embodiment of the small parts vending machine for airplanes constructed in accordance with the principles of the present invention.
Figure 2:
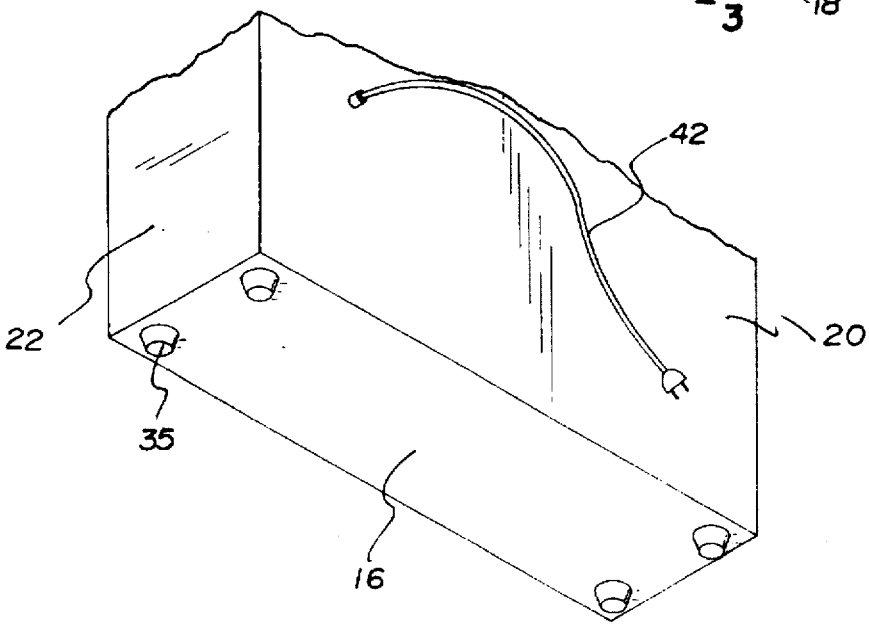
FIG. 2 is partial rear perspective view of the present invention.

With reference now to the drawings, and in particular, to FIGS. 1–6 thereof, the preferred embodiment of the new and improved small parts vending machine for airplanes embodying the principles and concepts of the present invention and generally designated by the reference number 10 will be described.

Specifically, it will be noted in the various Figures that the device relates to a new and improved small parts vending machine for airplanes for dispensing small airplane parts at times when parts are otherwise unavailable. In its broadest context, the device consists of a housing, a powering and programming means, an input means, a credit card input portion, a plurality of dispensing coils, and a plurality of airplane parts. Such components are individually configured and correlated with respect to each other so as to attain the desired objective.

The device 10 includes a housing 12 having a generally rectangular configuration. The housing 12 having a top wall 14, a bottom wall 16, a front wall 18, a rear wall 20, two side walls 22, and a hollow interior 24. The bottom wall 16 has four legs 25 secured thereto to support the housing 12 above a recipient surface. The four legs 25 are disposed in four corners of the bottom wall 16. The front wall 18 has an opening 26 therethrough in a lower portion thereof. The opening 26 spans more than half of the entire length of the housing 12. The housing 12 includes a dispensing ramp 28 secured within the hollow interior 24. The dispensing ramp 28 comprises a planar portion 30 having a first end secured to the rear wall 20. The dispensing ramp 28 includes an arcuate portion 32 having an upper end secured to a second end of the planar portion 30. A lower end of the arcuate portion 32 terminates at the opening 26 in the front wall 18. An anti-theft bar 34 comprised of a planar member is secured to an inner surface of the front wall 18 disposed above the opening 26 therethrough in an angular orientation. The anti-theft bar prevents would-be-thieves from extending their arm and hand through the opening 26 and remove the airplane parts from within the housing 12. A dispensing bin 36 is secured to the front wall 18 disposed under the opening 26 therethrough. The dispensing bin 36 allows the airplane parts dispensed from within the housing 12 to be safely removed therefrom.

A powering and programming means 40 is secured within the hollow interior 24 of the housing 12 to the rear wall 18 thereof. An electric cord 42 extends outwardly from the powering and programming means 40 out of the rear wall 20 of the housing to couple with an electrical outlet.

An input means comprised of a computer screen 46 and key board 48 is secured to the front wall 18 of the housing 12. The computer screen 46 and key board 48 are electrically coupled with the powering and programming means 40.

A credit card input portion 52 is secured to the front wall 18 of the housing 12. The credit card input portion 52 is comprised of an input slot 54, a keyboard 56, and a receipt dispenser 58. The credit card input portion 52 is electrically coupled with the powering and programming means 40. A user simply slips their credit card into the input slot 54, uses the keyboard 56 to enter in their PIN. After approval is gained, the user selects the desired airplane part by using the key board 48 to scan the choices on the computer screen 46. After the selection is made, the credit card is billed and a receipt is dispensed through the receipt dispenser 58.

The device 10 also includes a plurality of dispensing coils 62 each having a generally U-shaped housing 64. Each of the coils 62 is secured within the hollow interior 24 of the housing 12 to the rear wall 20 thereof. The dispensing coils 62 are operably coupled with the powering and programming means 40. Once the desired airplane part is selected through the input means, the powering and programming means 40 selects the dispensing coil 62 corresponding part and by rotating the coil, the selected part falls from an end of the coil 62 onto the dispensing ramp 28, out of the opening 26 and into the dispensing bin 36.

A plurality of airplane parts 68 are removably disposed within the plurality of dispensing coils 62. A great variety of airplane parts 68 can be displayed within the housing 12 depending upon the particular vendor.

An instruction panel 72 can be disposed on the front wall 18 above the computer screen 46 to provide guidance in using the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A small parts vending machine for airplanes comprising, in combination:

a housing having a generally rectangular configuration, the housing having a top wall, a bottom wall, a front wall, a rear wall, two side walls, and a hollow interior, the bottom wall having four legs secured thereto to support the housing, the front wall having an opening therethrough in a lower portion thereof spanning more than half of a length of the housing, the housing including a dispensing ramp secured within the hollow interior, the dispensing ramp comprising a horizontal planar portion having a first end secured to the rear wall, the dispensing ramp including an arcuate portion having an upper end secured to a second end of the planar portion, a lower end of the arcuate portion terminating at the opening in the front wall, an anti-theft bar comprising a planar member secured to an inner surface of the front wall disposed above the opening therethrough in an angular orientation, a dispensing bin secured to the front wall disposed under the opening therethrough;

a powering and programming means secured within the hollow interior of the housing to the rear wall thereof, wherein an electric cord extends outwardly from the powering and programming means out of the rear wall of the housing to couple within an electric outlet;

an input means comprised of a computer screen and key board secured to the front wall of the housing, the computer screen and key board being electrically coupled with the powering and programming means;

a credit card input portion secured to the front wall of the housing, the credit card input portion comprised of an input slot, a keyboard, and a receipt dispenser, the credit card input portion being electrically coupled with the powering and programming means, whereby a user may slip a credit card into the input slot and use the keyboard to enter a personal identification number;

a plurality of dispensing coils each having a generally U-shaped housing, each of the coils secured within the hollow interior of the housing to the rear wall thereof, the dispensing coils being operably coupled with the powering and programming means;

a plurality of airplane parts removably disposed within the plurality of dispensing coils; and an instruction panel disposed on the front wall above the computer screen to provide user guidance.

* * * * *